United States Patent [19]

Moon

[11] Patent Number: 4,959,875

[45] Date of Patent: Oct. 2, 1990

[54] LIMB PROTECTOR DEVICE

[76] Inventor: Theodore L. Moon, 713 Cusic St., Lake Charles, La. 70605

[21] Appl. No.: 330,351

[22] Filed: Mar. 29, 1989

[51] Int. Cl.[5] ..... A41D 13/00

[52] U.S. Cl. ..... 2/22; 128/165; 2/16

[58] Field of Search ..... 2/2, 22, 16, 21, 23, 2/24, 170; 128/77, 80 R, 80 A, 80 B, 80 C, 80 F, 80 G, 155, 157, 160, 165

[56] References Cited

U.S. PATENT DOCUMENTS

| | | | |
|---|---|---|---|
| 1,772,923 | 8/1930 | Volz | 2/22 |
| 3,189,073 | 6/1965 | Todd | 2/170 |
| 3,189,919 | 6/1965 | Chase | 2/16 |
| 3,621,489 | 11/1971 | Keller | 2/22 |
| 3,828,369 | 8/1974 | Swallow | 128/165 |
| 4,001,953 | 1/1977 | Fugere | 2/22 |
| 4,217,893 | 8/1980 | Payton | 128/165 |
| 4,306,315 | 12/1981 | Castiglia | 2/22 |
| 4,503,566 | 3/1985 | Wheeler | 2/22 |
| 4,674,157 | 6/1987 | Litz | 2/22 |
| 4,756,026 | 7/1988 | Pierce | 2/22 |
| 4,793,333 | 12/1988 | Marquette | 2/22 |

FOREIGN PATENT DOCUMENTS

| | | | |
|---|---|---|---|
| 1935278 | 7/1969 | Fed. Rep. of Germany | 2/22 |
| 2658050 | 7/1978 | Fed. Rep. of Germany | 2/22 |
| 80145 | 6/1919 | Switzerland | 128/157 |

*Primary Examiner*—Werner H. Schroeder
*Assistant Examiner*—Diana L. Biefeld
*Attorney, Agent, or Firm*—Leon Gilden

[57] ABSTRACT

A limb protector device is set forth formed with an arcuate convex shield including a coextensive laminated sheet of padding adhered to an interior surface of the shield. The shield includes a "U" shaped anchor secured along coextensively with one elongate edge of the shield spaced parallel from a "V" shaped clamp formed with a serrated clamping edge positioned coextensively with a second edge of the shield about an exterior face of the shield. An elastomeric band is positionable within the "V" shaped clamp to accommodate an initial adjustment of an individual's limb to be encompassed by the device. A "U" shaped clip is secured at a distal end of the band and is securable to the "U" shaped anchor for securement about the aforenoted individual.

11 Claims, 1 Drawing Sheet

LIMB PROTECTOR DEVICE

BACKGROUND OF THE INVENTION

1. Field of the Invention

The field of invention relates to limb protective devices, and more particularly pertains to a new and improved limb protector device accommodating a variety of individuals and provided with an initial adjustment mechanism to enable rapid and easy securement about an individual's limb.

2. Description of the Prior Art

The use of limb protectors of various types have been known in the prior art. Limb protectors of the prior art have included organizations generally suited for limited application to individuals about their limbs. The application of such devices for use with geriatric patients, for example, has at times provided a cumbersome use of the protective devices in that the patients may vary greatly in the girth of an associated limb. The instant invention attempts to overcome the deficiencies of the prior art by providing a limb protective device that enables an initial dimensional accommodation of an individual while providing an elongate shield of arcuate configuration to be easily and readily secured to an individual's limb. An example of a prior art device is set forth in U.S. Pat. No. 4,001,953 to Fugere provided with an elongate elastomeric tubular member encapsulating a shield between forwardmost layers of the device wherein the device of the Fugere patent requires an individual to project a limb through the device which is of cumbersome organization relative to geriatric patients and individuals of limited physical capacity.

U.S. Pat. No. 3,621,489 to Keller sets forth a shin guard provided with a discontinuous annular shield provided with a discontinuous interior annular cushion, but the Keller device is of an organization relatively removed from the instant invention requiring an encircling of an associated limb with attendant discomfort to a wearer of the device, particularly in an individual of limited physical ambulatory abilities.

U.S. Pat. No. 4,503,566 to Wheeler sets forth a protective leg and shoe covering provided with a two piece upper portion to securely fit about a user's lower leg with a flare portion to cover the top of a user's shoe. The device is provided to give additional support to the foot and shin region of an individual, but is of a relatively complex organization for use in combination with a shoe, as opposed to that of the instant invention.

U S Pat. No. 4,306,315 to Castiglia sets forth a shin guard provided in an elastomeric tubular member provided with a forwardly oriented rigid member positioned within the tubular member to be drawn over the shin portion of a user's leg, but is of a relatively difficult organization to be accommodated by an individual of limited capacity, as may be found in geriatric wards and homes throughout the country.

U.S. Pat. No. 4,756,026 to Pierce sets forth a limb protector provided with a polymeric foam formed with a series of elongate panels overlying the foam to provide protection to an individual's limb. The tubular arrangement of the Pierce patent provides similar difficulties with individuals of limited physical capacities, as Castiglia and Fugere patents.

As such, it may be appreciated that there is a continuing need for a new and improved limb protector device wherein the same addresses both the problems of ease of use and effectiveness in application, and in this respect, the present invention substantially fulfills this need.

SUMMARY OF THE INVENTION

In view of the foregoing disadvantages inherent in the known types of limb protective devices now present in the prior art, the present invention provides a limb protector device wherein the same may be readily secured about an individual during periods of need and may be further provided with initial adjustment mechanism to provide accommodation of individuals of varying limb diameters. As such, the general purpose of the present invention, which will be described subsequently in greater detail, is &o provide a new and improved limb protector device which has all the advantages of the prior art limb protective devices and none of the disadvantages.

To attain this, the present invention comprises a limb protector device formed with an arcuate elongate shield provided with a laminated padded interior surface. A "U" shaped anchor is positioned coextensively along one edge of the shield with posts orthogonally positioned and extending through parallel legs of the "U" shaped anchor to cooperate with slots formed in a "U" shaped clip to maintain alignment and registration of the "U" shaped clip relative to the anchor. A "V" shaped clamp provided with a serrated edge at a terminal end of a first leg and a second leg mounted about an axle formed at the apex defined by the first and second legs is provided to adjustably secure a free end of elastomeric band with the other end of the band secured to the "U" shaped clip.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended here&o. Those skilled in the art will appreciate that the conception, upon which this disclosure is based, may readily be utilized as a basis for the designing of other structures' methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved limb protection device which has all the advantages of the prior art limb protective devices and none of the disadvantages.

It is another object of the present invention to provide a new and improved limb protection device which may be easily and efficiently manufactured and marketed.

It is a further object of the present invention to provide a new and improved limb protection device which is of a durable and reliable construction.

An even further object of the present invention is to provide a new and improved limb protection device which is susceptible of a low cost of manufacture with regard to both materials and labor, and which accordingly is then susceptible of low prices of sale to the consuming public, thereby making such limb protection devices economically available to the buying public.

Still yet another object of the present invention is to provide a new and improved limb protection device which provides in the apparatuses and methods of the prior art some of the advantages thereof, while simultaneously overcoming some of the disadvantages normally associated therewith.

Still another object of the present invention is to provide a new and improved limb protection device wherein the same may be readily adjusted and then selectively secured and removed about an individual's limb.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
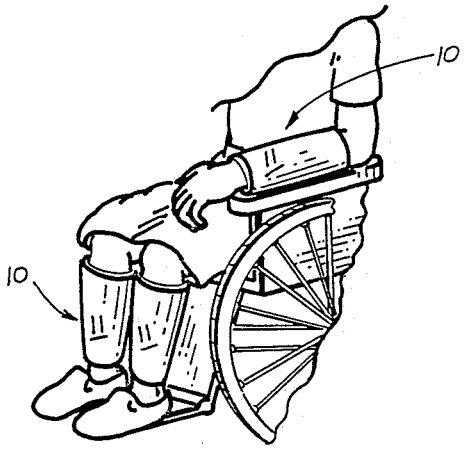
FIG. 1 is an isometric illustration of the instant invention secured about various limbs or an individual.

With reference now to the drawings, and in particular to FIGS. 1 to 4 thereof, a new and improved limb protection device embodying the principles and concepts of the present invention and generally designated by the reference numeral 10 will be described.

More specifically, it will be noted that the limb protection device 10 essentially comprises an elongate arcuate shield 11 formed with rounded corners to minimize irritation when worn by an individual and defining an arc of approximately 150 to 180 degrees with 150 degrees of arc preferred. The arc of the elongate shield 11 is utilized to maximize protection and minimize irritation when worn by an individual. The shield 11 is formed with a first elongate edge 12 and a spaced parallel second elongate edge 18. A coextensive padding 14 is laminated to the interior concave surface of the shield 11 and generally utilizes a padding material 14 of memory retentent abilities of substantially one-half inch thickness. The shield 11 itself may be formed of aluminum, stainless steel, or of a dense rigid polymeric type material that will retain the configuration, as set forth above.

Secured along the second elongate edge 13 is a "U" shaped anchor 15 formed coextensively and positioned adjacent the second edge 18 formed with parallel legs extending away from the second edge 18 and formed with a series of posts 16 spaced medially and orthogonally relative to the legs of the anchor 15. The anchor 15 is configured to accept a "U" shaped clip 17. The "U" shaped clip 17 is provided with a forward leg 18 and a rearward leg 19. The forward leg 18 is provided with a series of recesses 20 spaced a distance substantially equal to the spacing of the posts 16 between the legs of the "U" shaped anchor 15 and recessed within the forward leg 18 a distance substantially equal to the diameter of the posts 16 to enable the "U" shaped clips 17 to maintain alignment wIthin the anchor 15 to enhance comfort and securement of the protection device 10 when secured about an individual.

Figure 4:
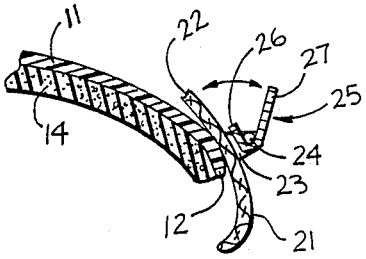
FIG. 4 is a partial sectional view, taken along the lines 4—4 of FIG. 2, in the direction indicated by the arrows.
Figure 2:
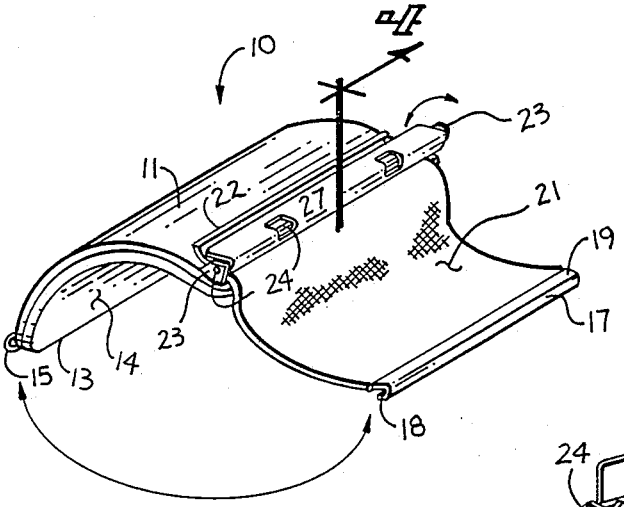
FIG. 2 is an isometric illustration of the instant invention.
Figure 3:
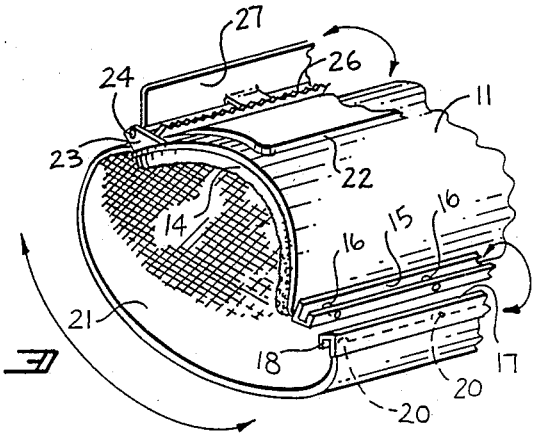
FIG. 3 is a further isometric illustration of the instant invention illustrating the opposite end of the device.

The rear leg 19 of the "U" shaped clip 17 secures an elongate edge of an elastomeric band 21. The elastomeric band 21is provided with a remote free end defining an edge generally parallel to the "U" shaped clip 17 to be received within a "V" shaped clamp 25. The "V" shaped clamp 25 is integrally secured adjacent the first elongate edge 12 and is provided with a first leg 26 including a serrated edge formed along the length of the free end of the first leg 26. The first leg 26 is of a first length less than that of the second leg 27 of the "V" shaped clamp wherein the second leg 27 and the first leg 26 define an apex to receive an axle 24 therewithin to provide a pivoting of the "V" shaped clamp to secure and release the band at its free end between the serrated first leg and the upper surface of the arcuate shield 11, as illustrated in FIG. 4. Extending upwardly from opposite ends of the shield 11 adjacent the first edge 12 are a plurality of upwardly extending spaced ears 23 to receive the axle 24 therethrough.

In use, the free end of the band 21 is presented between the spacing of the serrated first leg 26 on the upper surface of the shield 11 and thereafter clamped by rotation of the "V" shaped clamp by manipulation of the second leg 27 towards the outer surface of the shield 11. Thereafter, the elastomeric band is provided with initial adjustment whereupon the "U" shaped clip may be registered within the "U" shaped anchor 15 to provide for ease of securement of the device about a limb. Use of the device about various limbs and individuals merely requires the readjustment of the free end 22 of the band 21 to accommodate further individuals' anatomical variations of limb girths.

As to the manner of usage and operation of the instant invention, the same should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A limb protection device for securement about a limb of an individual comprising, an arcuate elongate shield including a padding laminated to and coextensive with a convex interior surface of said shield, and said shield further defined by a first elongate edge parallel to and spaced from a second elongate edge, and an anchor member secured coextensively with and adjacent the second edge is secured to an exterior surface of said shield to receive a clip member, and said clip member secured to a first end of a securement band, and a second free end of the securement band receivable within a clamp secured coextensively with and adjacent to the first edge of the shield on the exterior surface of the shield.

2. A limb protection device as set forth in claim 1 wherein the padding is formed of a resilient memory retentent material.

3. A limb protection device as set forth in claim 2 wherein said anchor member is defined by an elongate "U" shaped member formed with parallel legs, said parallel legs extending away from and orthogonally relative to the second edge.

4. A limb protection device as set forth in claim 3 wherein the parallel legs include a plurality of posts, each of the posts orthogonally mounted to the legs.

5. A limb protection device as set forth in claim 4 wherein the clip member is defined by a "U" shaped elongate clip including first and second clip legs wherein the first clip leg includes a series of recesses wherein each recess is defined by a configuration substantially equal to that of a diameter defined by each post, and each recess is spaced along the first leg a distance equal to the spacing defined by the posts along the anchor.

6. A limb protection device as set forth in claim 5 wherein the second clip leg has secured thereto a first end of the securement band.

7. A limb protection device as set forth in claim 6 wherein the clamp is defined by a "V" shaped clamp including a first clamp leg and a second clamp leg, and the first clamp leg includes a serrated edge.

8. A limb protection device as set forth in claim 7 wherein the second clamp leg is defined by a length greater than that of the first clamp leg, and an apex defined by the intersection of the first and second clamp legs receives an elongate axle secured thereto.

9. A limb protection device as set forth in claim 8 wherein the "V" shaped clamp is rotatably mounted relative to the exterior surface of the shield to adjustably clamp the second free end of the securement band between the serrated edge of the first clamp leg and the exterior surface of the band.

10. A limb protection device as set forth in claim 9 further including a first ear orthogonally positioned relative to the exterior surface of the shield, the first ear parallel to and spaced from a second ear to receive the axle therebetween, the first and second ears are spaced exteriorly of opposed ends of the "V" shaped clamp.

11. A limb protection device as set forth in claim 10 wherein the securement band is formed of a flexible elastomeric material to conform to an exterior configuration of the limb of the individual.

* * * * *